US005608176A

United States Patent [19]

Patterson

[11] Patent Number: 5,608,176

[45] Date of Patent: Mar. 4, 1997

[54] ELECTROMAGNETIC VALVE FOR PIPE ORGAN

[76] Inventor: Timothy J. Patterson, 6080 Linden Rd., Woodbury, Minn. 55125

[21] Appl. No.: 479,219

[22] Filed: Jun. 7, 1995

[51] Int. Cl.[6] ..... G10B 3/10

[52] U.S. Cl. ..... 84/337; 251/129.21; 84/339; 335/235; 335/276

[58] Field of Search ..... 84/334–335, 337–339, 84/341–343; 251/129.2, 129.21; 335/229, 235, 233, 276

[56] References Cited

U.S. PATENT DOCUMENTS 2,083,644 6/1937 Floro et al. ..... 84/339

4,851,800 7/1989 Peterson et al. ..... 335/229

5,370,029 12/1994 Kramer ..... 84/339

*Primary Examiner*—Patrick J. Stanzione

*Attorney, Agent, or Firm*—Jacobson and Johnson

[57] ABSTRACT

An electromagnetic valve for a pipe organ is located and operated so that the valve closure member opens and closes the windway to the pipe at an obtuse angle thereby slowing down the opening of the windway to prevent or minimize overblowing and eliminating or minimizing rebounding of the closure member when it closes the windway to minimize or eliminate unwanted continued speech by the pipe.

7 Claims, 2 Drawing Sheets

ELECTROMAGNETIC VALVE FOR PIPE ORGAN

FIELD OF THE INVENTION

This invention is directed toward pipe organs which use electromagnetic valves for opening and closing the windways into the pipes for controlling the pressurized air entering from the air chamber into the toe opening of the pipe to produce the speech or sound of each pipe.

DESCRIPTION OF THE PRIOR ART

U.S. Pat. No. 5,370,029 titled "ELECTROMAGNETICALLY OPERATED VALVE" by Kramer in general describes the typical operation of the pipe organ and some of the difficulties encountered when using an electromagnetic valve for opening and closing the windways to each pipe. For the purposes of these explanations and for understanding the operation of a pipe organ, the aforesaid '029 patent is a good reference. However, the 029's solution of the problems resulting from "bouncing" or "rebounding" of the toe opening closure member when using an electromagnetic valve is totally different and distinct from the solution arrived at by the instant invention. The '029 patent utilizes a permanent magnet and a second solenoid in conjunction with the electromagnetic valve to control the opening and closing of the windways. This is not only quite complex but also is quite costly when one considers that each pipe in the organ and associated windway requires a separate electromagnetic valve.

SUMMARY OF THE INVENTION

The present invention uses a conventional solenoid-operated electromagnetic valve which has a closure member attached to a movable arm which in turn is spring biased to hold the closure member against the windway to prevent pressurized air from entering the pipe when the solenoid is not energized. When the solenoid is energized by the organist operating the keyboard the arm is swung against the force of the spring so that the closure member opens the windway to permit pressurized air to enter into the associated pipe. The electromagnetic valve is mounted in a fashion such that the arm pivotally moves or swings in a fashion to move the closure member at an obtuse angle. When the solenoid is energized the closure member is moved away from the windway at an obtuse angle so that the windway is opened at a somewhat slow rate so that overblowing by a sudden rush of air into the pipe is minimized. For turning off or closing off the pressurized air to the pipe the closure member is brought into position at this obtuse angle so that "rebounding" or "bouncing" is virtually eliminated thereby eliminating or at least minimizing undesirable continued speech of the pipe.

DESCRIPTION OF THE PREFERRED EMBODIMENTS

Figure 1:
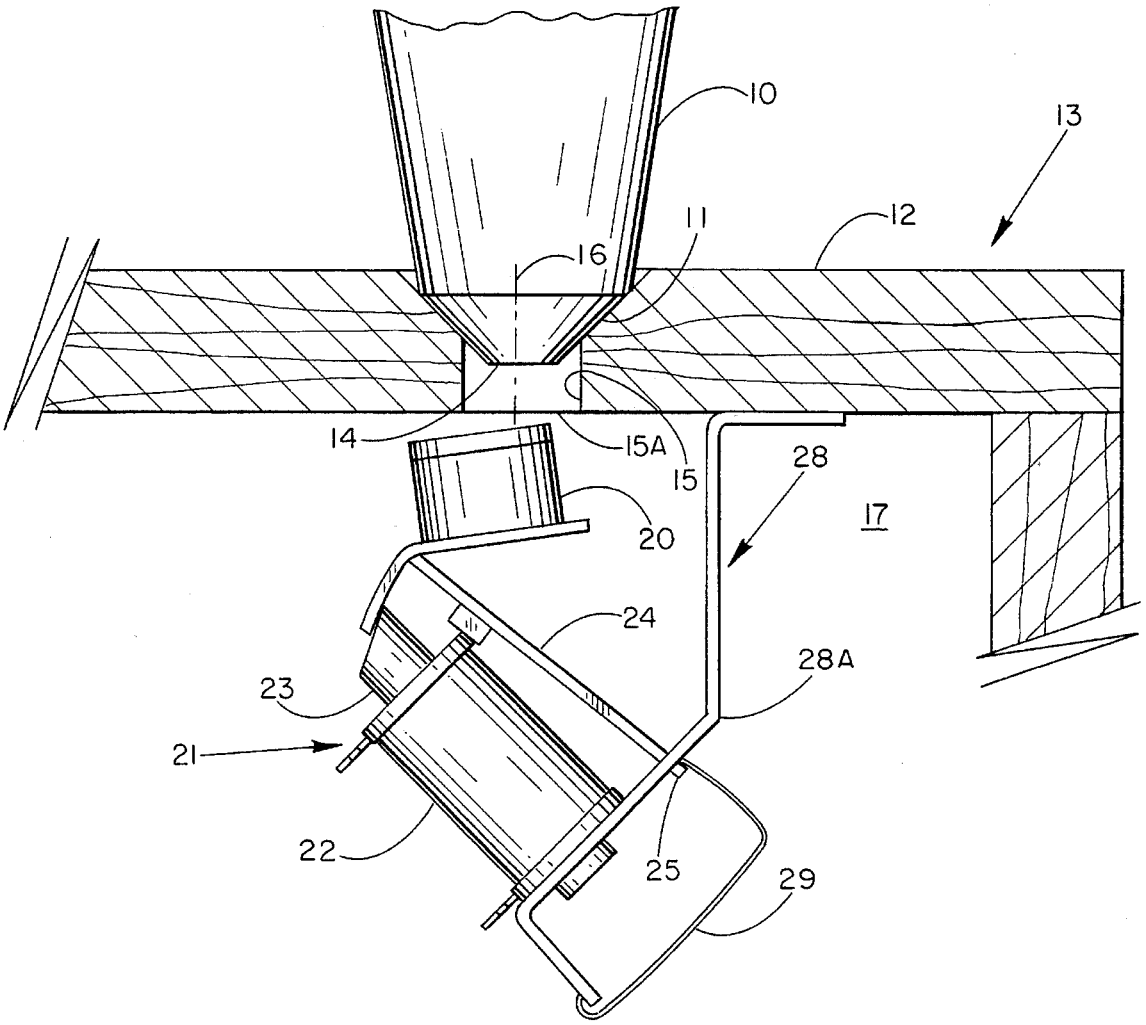
FIG. 1 is a partially sectioned diagrammatical view of a preferred embodiment of the invention illustrating the closure member in the open position.
Figure 2:
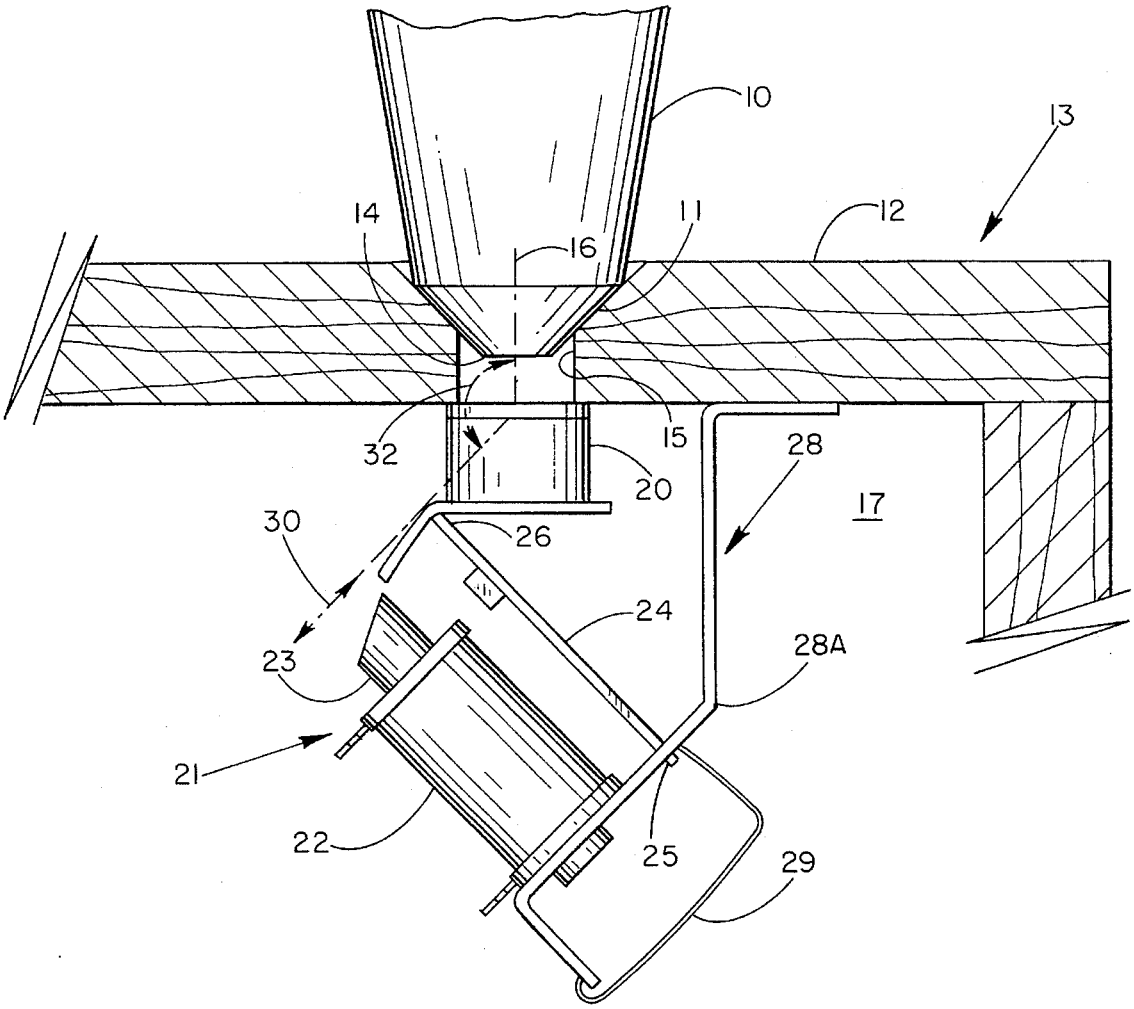
FIG. 2 is a view similar to FIG. 1 but with the closure member in the closed position.

Typically and conventionally each organ pipe 10 has one end resting in a beveled opening 11 in the top cover or toeboard 12 of a wind chest generally designated by reference numeral 13. The toe of pipe 10 has an opening at 14 in air communication with a windway 15 in toeboard 12 which is in air communication with air chamber 17. Pipe 10 extends generally from its engagement in toeboard 12 so that it is at about ninety degrees or normal to the plane of toeboard 12. As explained in greater detail in the aforementioned '029 patent, when windway 15 is open low pressure air from air chamber 17 contained in windchest 13 is allowed to enter windway 15 through its input end 15A and flow into opening 14 of pipe 10 creating the speech or sound of the pipe. When windway 15 is closed off, the sound or speech of the pipe 10 is terminated. Typically, and which has become quite conventional, a closure member 20 for opening and closing windway 15 is operated by an electromagnetic valve generally designated by reference numeral 21. Valve 21 comprises an electrical winding or solenoid 22 surrounding a core element 23 with core 23 in magnetic circuit with a generally L-shaped arm or armature 24 which is pivotally attached at one end at 25. Joined to arm 24 generally at the "L" corner is a closure member 20 so that the latter moves along with arm 24. Valve 21 is suitably mounted on a support bracket generally designated by reference numeral 28. A spring member 29 is attached between an end of arm 24 near pivot point 25 and bracket 28 to normally bias or urge arm 24 to a position so that closure member 20 closes off windway 15. To make a pipe "speak" or produce sound, the organist moves a certain associated key on a keyboard (not shown). This energizes solenoid 22 so that magnetic core 23 pulls arm 24 counterclockwise, as observed in the drawings, against the force of spring 29 so that closure member 20 is pulled away from windway 15 (see FIG. 1) to allow passage of pressurized air into pipe 10 through its toe opening 14. Valve 21 is mounted to windchest 13 within air chamber 17 in such a fashion that closure member 20 is moved from the closed to the open position and from the open to the closed position along a path generally designated by dashed line 30. The arrangement is made so that line 30 intersects and forms an obtuse angle designated by curved dash line 32 with the longitudinal axis 16 of windway 15. Angle 32 may range from about one hundred twenty degrees to about one hundred fifty degrees and appears to be optimum at about one hundred thirty-five degrees. It has been found that by this arrangement closure member 20 opens windway 15 at a rate which is slow enough to prevent or minimize overblowing or fast speech which occurs when too much air is initially allowed to enter into the pipe too rapidly when the windway is opened. The angular movement of closure member 20 to close off windway 15 results in virtually imperceptible rebounding or bouncing of the closure member thereby virtually eliminating the undesirable continued speech by the pipe which occurs if the closure member bounces or rebounds when impacting the toe board so that air enters the pipe even after the organist has presumably closed the valve by operation of the keyboard.

Bracket 28 is made out of some suitable relatively stiff and firm material suitable for supporting valve 21 and which will not produce any substantial reverberation when the valve is operated to open and close the windway. Bracket 28 is mounted to the underside of toe board 12 in some convenient fashion. It has a section that extends normal to the plane of toe board 12 inward in chamber 17. At a predetermined distance from toe board 12 bracket 28 angles at 28A in a direction so that it will extend opposite windway 15. It has an opening at 25 to accommodate the end of arm 24 so that it can be pivotally attached in some convenient fashion to bracket 28. The length of the angular extension is such that it accommodates electromagnetic valve 21. Valve 21 can be mounted to bracket 28 in any convenient fashion not constituting a part of the instant invention. A short extension at the end of bracket 28 is provided as an anchoring point for one end of spring 29.

Although the drawings illustrate the line of travel of closure member 20 to be a straight line, because of the pivot action of arm 24 there is a slight curvature which is minimal because of the short distance of travel that's involved. Also, closure member 20 is mounted to arm 24 at an angle that is selected so that when arm 24 operates to move closure member 20 to close off windway 15, the windway is completely closed and the closing surface of closure member 20 sits firmly and snugly against the underside of toe board 12 and leaves no opening for air from chamber 17 to enter into windway 15.

I claim:

1. In a pipe organ wherein the pipes are mounted generally with the toes of the pipes in air communication with corresponding windways for receiving pressurized air from the chamber of the organ wind chest, a valve for selectively opening and closing each windway, comprising:

a) an electromagnet comprising an electrical solenoid mounted to the organ wind chest;

b) a pivotally mounted movable arm in magnetic circuit with said electromagnet;

c) a closure member for the windway mounted on said arm;

d) a spring member attached to said arm normally urging the arm in a direction such that said closure member closes its associated windway;

e) said electromagnet when energized moving said arm in a direction to move said closure member away from its associated windway to open said windway;

f) said arm mounted so that it moves said closure member toward and away from its associated windway at an obtuse angle with respect to the longitudinal axis of the associated windway.

2. The valve as described in claim 1 wherein said obtuse angle ranges from about one hundred twenty degrees to about one hundred fifty degrees.

3. The valve as described in claim 1 wherein said obtuse angle is about one hundred thirty-five degrees.

4. In a pipe organ which has an electromagnetic valve with a closure member for opening and closing each of the pipe windways to control the flow of pressurized air to the pipe from a pressurized air chamber in a wind chest, the improvement comprising:

means for mounting the electromagnetic valve to the wind chest so that the closure member moves away from and toward the windway at an obtuse angle with respect to the longitudinal axis of the windway as said electromagnetic valve is energized and deenergized.

5. The invention as described in claim 4 wherein said mounting means comprises a bracket, said bracket having a first leg attached to the wind chest and a second leg, said electromagnetic valve mounted on said second leg, said second leg angled with respect to said first leg so that the electromagnetic valve closure member moves toward and away from its associated windway at said obtuse angle.

6. The invention as in claim 4 wherein said angle ranges from about one hundred twenty degrees to about one hundred fifty degrees.

7. The invention as in claim 4 wherein said angle is about one hundred thirty-five degrees.

* * * * *